US007190341B2

(12) United States Patent
Yu

(10) Patent No.: US 7,190,341 B2
(45) Date of Patent: Mar. 13, 2007

(54) LIQUID CRYSTAL DISPLAY AND DRIVING METHOD THEREOF

(75) Inventor: Jian-Shen Yu, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 591 days.

(21) Appl. No.: 10/802,956

(22) Filed: Mar. 17, 2004

(65) Prior Publication Data

US 2005/0057465 A1 Mar. 17, 2005

(30) Foreign Application Priority Data

Aug. 27, 2003 (TW) ..... 92123553 A

(51) Int. Cl.
*G09G 3/36* (2006.01)

(52) U.S. Cl. ..... 345/98; 345/87

(58) Field of Classification Search ..... 345/87–90, 345/92–96, 98–100, 204–205, 209–214
See application file for complete search history.

(56) References Cited

U.S. PATENT DOCUMENTS 6,020,769 A * 2/2000 Vallancourt ..... 327/94
7,042,431 B1 * 5/2006 Washio et al. ..... 345/98
2002/0059336 A1 * 5/2002 Matsuyama ..... 707/500

* cited by examiner

*Primary Examiner*—Richard Hjerpe
*Assistant Examiner*—Mansour M. Said
(74) *Attorney, Agent, or Firm*—Thomas, Kayden, Horstemeyer & Risley

(57) ABSTRACT

A driving method of liquid crystal display. Voltage levels of pre-charging signals applied to storage electrodes vary before scan signals are applied to scan lines. Partial response voltage of the variations in voltage levels of pre-charging signals are respectively coupled to storage capacitors within pixels by capacitors. When the scan signals are applied to the scan lines, voltage swings of the pixel capacitors charged by image data on data lines decrease, rapidly charging the pixels.

9 Claims, 4 Drawing Sheets

LIQUID CRYSTAL DISPLAY AND DRIVING METHOD THEREOF

BACKGROUND OF THE INVENTION

1. Field of the Invention

The present invention relates to a liquid crystal display and driving method thereof, and in particular to a liquid crystal display and driving method thereof for rapidly charging pixel in the liquid crystal display.

2. Description of the Related Art

FIG. 1 is a unit circuit diagram of a conventional liquid crystal display. As shown in FIG. 1, the liquid crystal display comprises a common electrode COM10, a data line DL10, a scan line GL10, a thin film transistor (hereinafter referred to as "TFT") Tx10, a storage capacitor Cst10, and a liquid crystal cell Clc10. The data line DL10 is coupled to a first terminal of the TFT Tx10, the scan line GL10 is coupled to a gate of the TFT Tx10, and the storage capacitor Cst10 is coupled between a second terminal of the TFT Tx10 and the common electrode COM10. In addition, a capacitor Cgd10 is a parasitic capacitor.

According to FIG. 1, in the conventional liquid crystal display, both the storage capacitor Cst10 and the liquid crystal cell Clc10 (equivalent to a capacitor) are coupled between the TFT Tx10 and the common electrode COM10. At a frame time, pixel voltage Vpx10 of the display unit varies within broad range, such that sufficient time is required for a voltage signal on the data line DL to charge the capacitors Cst10 and Clc10. A voltage level of the pixel voltage Vpx10 can accurately reach a voltage level corresponding to an image. However, as resolution of the liquid crystal display increases, charge time of the capacitors Clc10 and Cst10 decreases so that the pixel voltage Vpx10 cannot reach the voltage level corresponding to the image, degrading efficiency and quality of the liquid crystal display.

FIG. 2 is a timing chart of a conventional liquid crystal display unit. At a frame time Frt10 starting from time t2, voltage Vg10 of the scan line GL10 increases and the TFT Tx10 is turned on. Positive signal of the image, as compared with the common voltage on the common electrode COM10, on the data line DL10 is input to the liquid crystal cell Clc10 and the storage capacitor Cst10 via the TFT Tx10, and the pixel voltage Vpx10 increases. The pixel voltage Vpx10 varies by a full swing. At time t3, the voltage Vg10 decreases, the TFT Tx10 is turned off, and the capacitor Cgd10 couples the voltage Vg10 on the scan line GL10, resulting in a voltage drop of the pixel voltage Vpx10.

At time t5, the voltage Vg10 increases to turn on the TFT Tx10. Negative signal of the image, as compared with the common voltage on COM10, on the data line DL10 is input to the liquid crystal cell Clc10 and the storage capacitor Cst10 via the TFT Tx10, and the pixel voltage Vpx10 decreases. Similarly, the pixel voltage Vpx10 varies by a full swing. At time t6, the voltage Vg10 decreases to turn off the TFT Tx10, and the capacitor Cgd10 couples the voltage Vg10, resulting in a voltage drop on the pixel voltage Vpx10.

As described above, the swing of the voltage of the pixel in the conventional technology is large. Trends toward high resolution LCD devices and short charge time of pixels result in the problem of insufficient charging time of the pixel, such that there is a need to reduce the amplitude of pixel voltage swing during charging period, thereby more rapidly charging the pixel.

SUMMARY OF THE INVENTION

Accordingly, an object of the present invention is to provide a driving method for rapidly charging pixels of a liquid crystal display by reducing the voltage swing of a pixel during charging period.

Another object of the invention is to provide a liquid crystal display with insufficient charge time for pixels, enhancing efficiency and quality of the display.

According to the object described above, the present invention provides a liquid crystal display. The liquid crystal display comprises a plurality of data lines, a plurality of scan lines, a plurality of storage electrodes, at least one common electrode, a plurality of pixel units, a scan line driver, and a pre-charging driver. The storage electrodes are disposed corresponding to the scan lines. Each pixel unit corresponds to one set of interlacing data and scan lines. Each pixel unit comprises a TFT, a storage capacitor, and a liquid crystal cell. The TFT has a gate coupled to the corresponding scan line, a first electrode coupled to the corresponding data line, and a second electrode. The storage capacitor is coupled between the corresponding storage electrode and the second terminal. The liquid crystal cell is coupled between the second electrode and the common electrode.

The scan line driver sequentially generates a plurality of scan signals and respectively outputs the scan signals to the scan lines. The pre-charging driver sequentially generates a plurality of pre-charging signals, respectively outputs the pre-charging signals to the storage electrodes, drives the pre-charging signals to vary periodically, and controls variations of voltage levels of the pre-charging signals to occur before the scan signals are applied to the scan lines.

The present invention further provides a driving method for rapidly charging pixels of a liquid crystal display. First, a plurality of storage electrodes is provided each corresponding to one scan line and coupled to one terminal of a storage capacitor. A plurality of pre-charging signals are sequentially generated and respectively output to the storage electrodes, varying periodically. A plurality of scan signals are sequentially generated and respectively output to the scan lines. Finally, a variation of a voltage level of each of the pre-charging signals occurs before one scan signal is applied to the corresponding scan line.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 3:
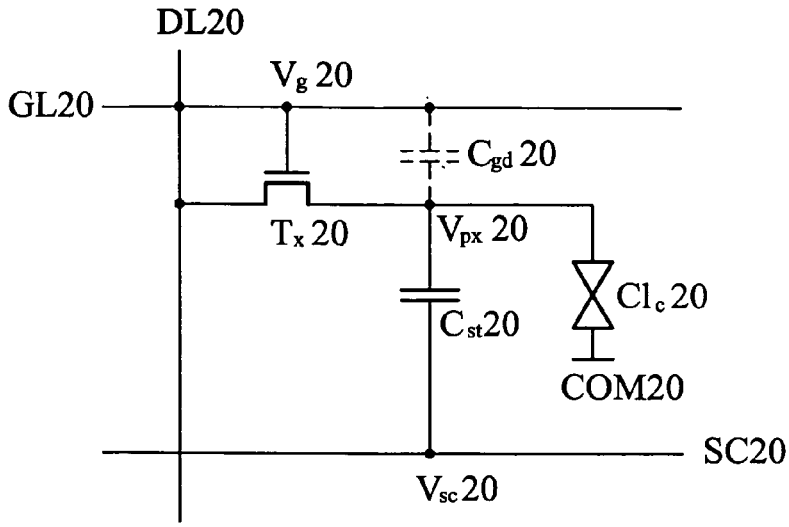
FIG. 3 is a unit circuit diagram of a liquid crystal display of the present invention.

FIG. 3 is a unit circuit diagram of a liquid crystal display of the present invention. A liquid crystal display unit comprises a storage electrode SC20, a common electrode COM20, a data line DL20, a scan line GL20, a thin film transistor (hereinafter referred to as "TFT") Tx20, a storage capacitor Cst20, and a liquid crystal cell Clc20. The data line DL20 is coupled to a first terminal of the TFT Tx20, and the scan line GL20 is coupled to a gate of the TFT Tx20. The storage capacitor Cst20 is coupled between a second terminal of the TFT Tx20 and the storage electrode SC20. The liquid crystal cell Clc20 is coupled between a second terminal of the TFT Tx20 and the common electrode COM20. In addition, a capacitor Cgd20 is a parasitic capacitor.

The driving method of the present invention is described below.

Figure 4:
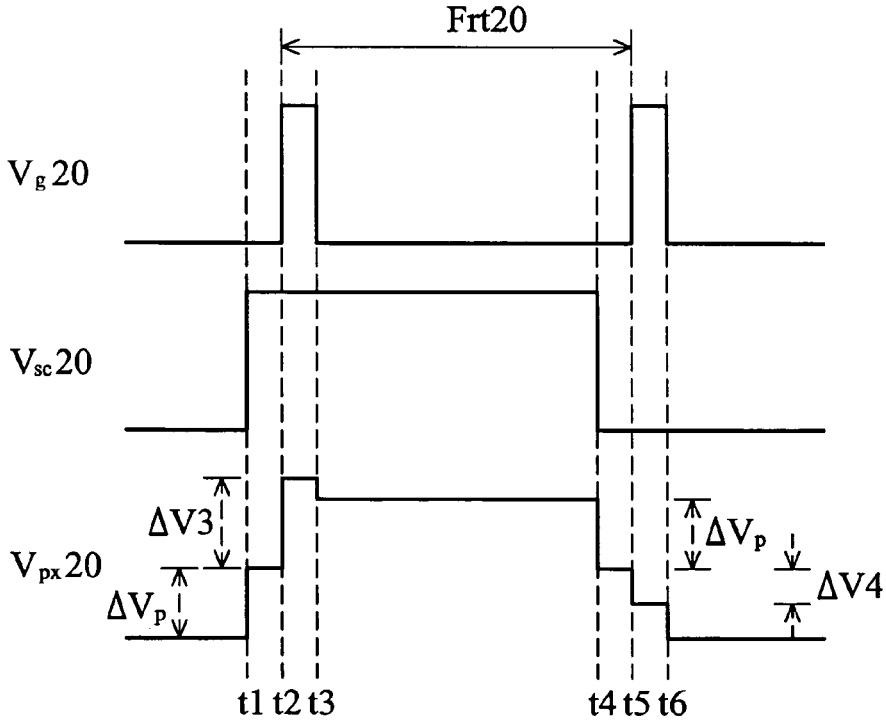
FIG. 4 is a timing chart of the unit circuit diagram in FIG. 3.

Referring to FIG. 4, at time t1, a pre-charging signal Vsc20 applied to the storage electrode SC20 changes from a low-level voltage to a high-level voltage. Since the storage capacitor Cst20 couples to the pre-charging signal Vsc20, a positive voltage jump ΔVp is coupled to a pixel voltage Vpx20.

Figure 1:
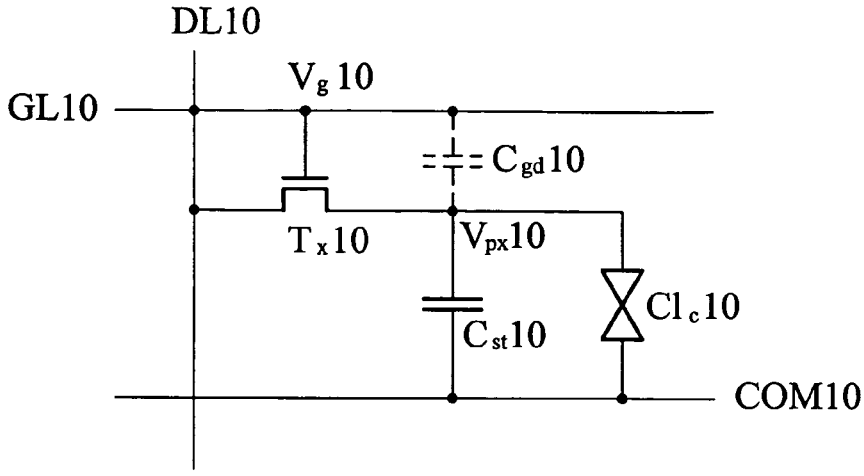
FIG. 1 ( RELATED ART )
FIG. 1 is a unit circuit diagram of a conventional liquid crystal display.
Figure 2:
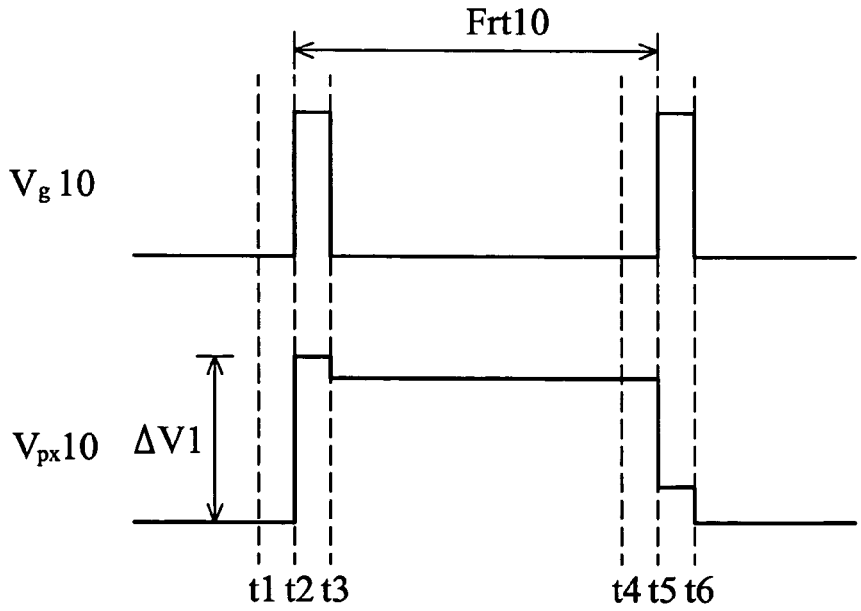
FIG. 2 ( RELATED ART )
FIG. 2 a timing chart of the conventional liquid crystal display unit.

At time t2, frame time Frt20 begins, and a scan signal Vg20 is applied to the scan line GL20 to turn on the TFT Tx20. Positive image data on the data line DL20 charges the storage capacitor Cst20 and a liquid crystal cell Clc20, and the pixel voltage Vpx20 increases continuously. Referring to FIG. 4, a swing in the pixel voltage Vpx20 is reduced to ΔV3 during charging time, less than ΔV1 of FIG. 1.

At time t3, the scan signal Vg20 decreases to turn off the TFT Tx20, and the capacitor Cgd20 couples to the voltage of the scan signal Vg20, resulting in a voltage drop on the pixel voltage Vpx20.

At time t4, the pre-charging signal Vsc20 changes from a high-level voltage to a low-level voltage. Since the storage capacitor Cst20 couples to the pre-charging signal Vsc20, a negative voltage jump ΔVp is coupled to the pixel voltage Vpx20.

At time t5, the frame time Frt20 ends and the scan signal Vg20 is applied to the scan line GL20 again to turn on the TFT Tx20. Negative image data on the data line DL20 is applied to the storage capacitor Cst20 and the liquid crystal cell Clc20, and the pixel voltage Vpx20 continuously decreases. Pixel voltage swing during charging time is reduced to ΔV4, less than ΔV1 of FIG. 1.

At time t6, the voltage of the scan signal Vg20 decreases to turn off the TFT Tx20, and the capacitor Cgd20 couples the voltage Vg20, resulting in a voltage drop on the voltage Vpx20.

As described above, before the scan signal Vg20 is applied to the scan line GL20, the pre-charging signal Vsc20 applied to the storage electrode SC20 varies. The pre-charged voltage ΔVp on the pixel voltage Vpx20 is approximately equal to the swing of Vsc20 multiplying a factor of Cst20/(Cst20+Clc20).

Figure 5:
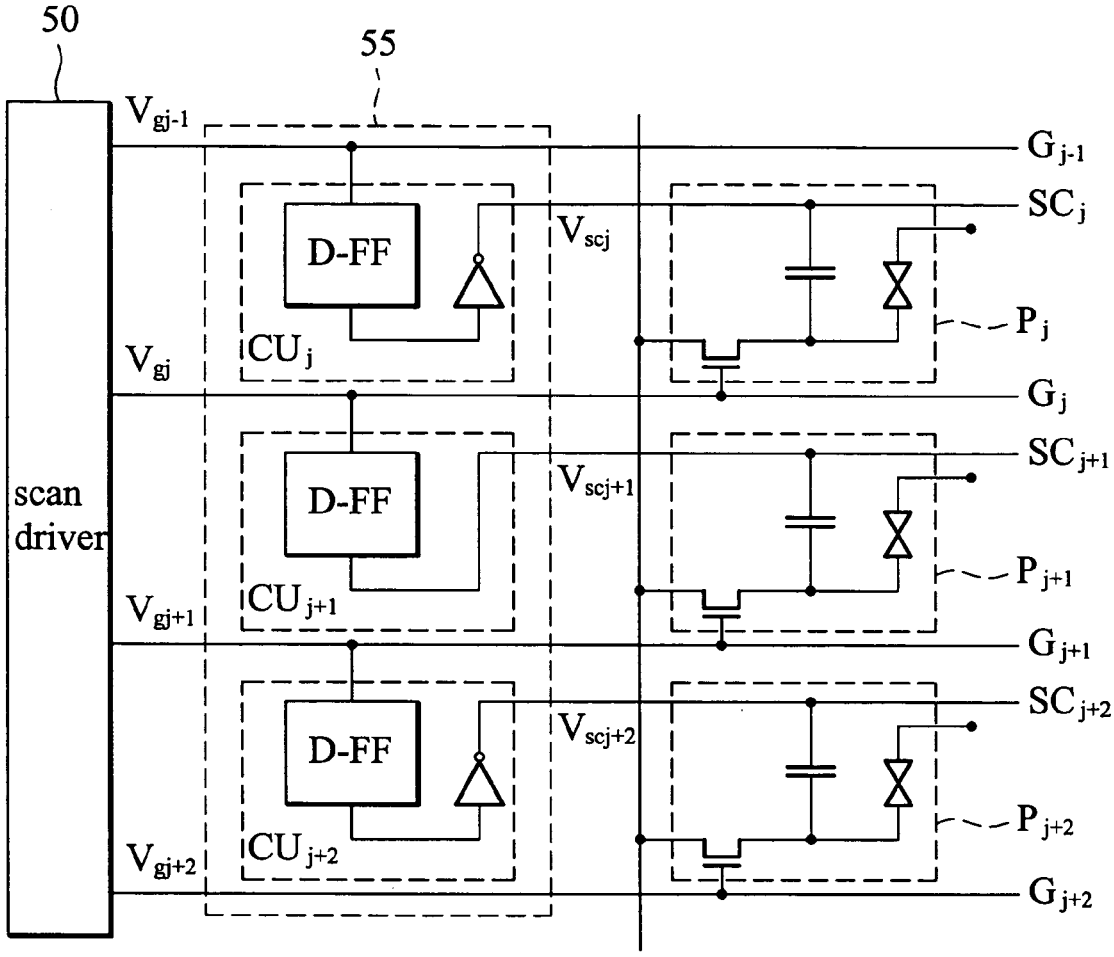
FIG. 5 shows schematic diagram of the liquid crystal display of the present invention.

The present invention further provides a liquid crystal display. Referring to FIG. 5, the liquid crystal display comprises data lines, scan lines $G_{j-1}$ to $G_{j+2}$, storage electrodes $SC_j$ to $SC_{j+2}$, a common electrode, pixel units $P_j$ to $P_{j+2}$, and a scan driver 50. The storage electrodes $SC_j$ to $SC_{j+2}$ are disposed corresponding to the scan lines $G_j$ to $G_{j+2}$, and the pixel units are disposed corresponding to sets of interlacing data lines and scan lines $G_{j-1}$ to $G_{j+2}$. The scan driver 50 sequentially outputs scan signals $Vg_{j-1}$ to $Vg_{j+2}$ to scan lines $G_{j-1}$ to $G_{j+2}$.

Each of the pixel units $P_j$ to $P_{j+2}$ comprises a TFT, a storage capacitor, and a liquid crystal cell. A gate and first terminal of the TFT are coupled to the corresponding scan lines and the corresponding data line respectively. The storage capacitor is coupled between a second terminal of the TFT and the corresponding storage electrode. The liquid crystal cell is coupled between the second terminal and the common electrode.

In addition, the liquid crystal display further comprises a pre-charging driver 55. The pre-charging driver 55 sequentially outputs pre-charging signals $Vsc_j$ to $Vsc_{j+2}$ to the storage electrodes $SC_j$ to $SC_{j+2}$. As a result, voltage levels of the pre-charging signals $Vsc_j$ to $Vsc_{j+2}$ vary periodically, and variations in the voltage levels of the pre-charging signals $Vsc_j$ to $Vsc_{j+2}$ occur before scan signals $Vg_j$ to $Vg_{j+2}$ are applied to the $G_j$ to $G_{j+2}$.

It is noted that the pre-charging driver 55 is coupled to the scan lines $G_{j-1}$ to $G_{j+1}$. When the scan signals $Vg_{j-1}$ to $Vg_{j+1}$ are output to the scan lines $G_{j-1}$ to $G_{j+1}$ respectively, the voltage levels of the pre-charging signals $Vsc_j$ to $Vsc_{j+2}$ are triggered to vary respectively.

The pre-charging driver 55 may comprise a plurality of pre-charging units $CU_j$ to $CU_{j+2}$. Each of the pre-charging units $CU_j$ to $CU_{j+2}$ is coupled between one of the scan lines $G_{j-1}$ to $G_{j+1}$ and one of the storage electrodes $SC_j$ to $SC_{j+2}$. For two adjacent pre-charging units, such as pre-charging units $CU_j$ and $CU_{j+1}$, the pre-charging unit $CU_j$ has a D-type flip-flop (D-FF), for example, and the pre-charging unit $CU_{j+1}$ has a D-FF and an inverter in addition. Hence, polarities of any two adjacent pre-charging units are opposite.

Figure 6:
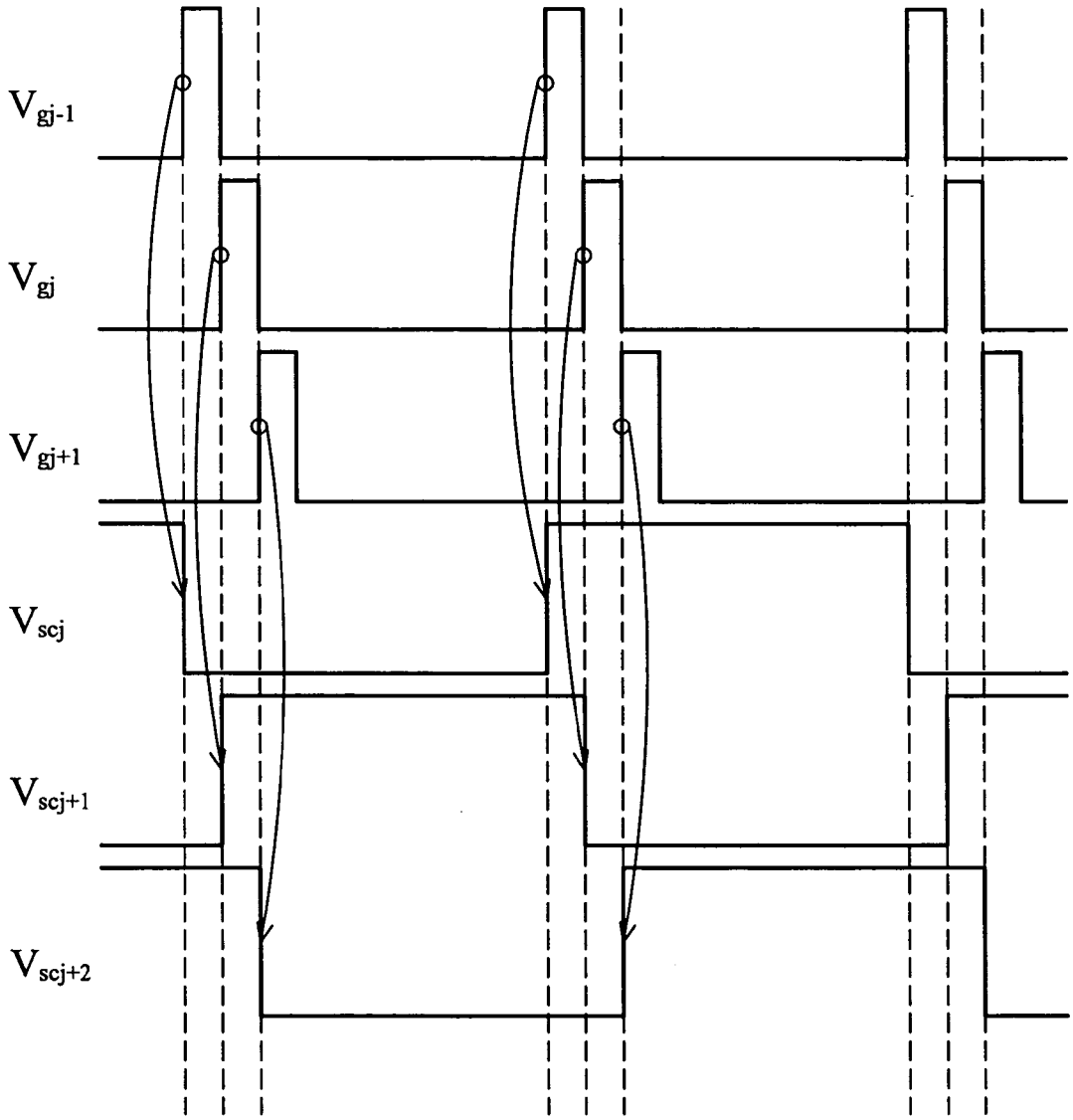
FIG. 6 is a timing chart of the liquid crystal display in FIG. 5.

Referring to FIGS. 5 and 6, the scan driver 50 sequentially outputs scan signals $Vg_{j-1}$ to $Vg_{j+2}$ to the scan lines $G_{j-1}$ to $G_{j+2}$. The pre-charging driver 55 also sequentially outputs pre-charging signals $Vsc_j$ to $Vsc_{j+2}$ to the storage electrodes $SC_j$ to $SC_{j+2}$.

It is noted that the voltage levels of the pre-charging signals $Vsc_j$ to $Vsc_{j+2}$ vary periodically, and variations in the voltage levels of the pre-charging signals $Vsc_j$ to $Vsc_{j+2}$ occur before scan signals $Vg_j$ to $Vg_{j+2}$ are applied to the scan lines $G_j$ to $G_{j+2}$. For example, variation of the voltage level of the pre-charging signals $Vsc_j$ occurs before scan signal $Vg_j$ is applied to the $G_j$.

As shown in FIG. 6, the scan signals $Vg_{j-1}$ to $Vg_{j+1}$ trigger the pre-charging driver 55 to generate the pre-charging signals $Vsc_j$ to $Vsc_{j+2}$, respectively. In this manner, the scan signal output to the scan line of a row triggers the pre-charging signal for output to the storage electrode of the next row. A voltage swing of the pixel on the next row thus decreases during the charging time for writing image data.

In the embodiment, the pre-charging units $CU_j$ and $CU_{j+2}$ both comprise a D-FF and an inverter, while the pre-charging units $CU_{j+1}$ comprises a D-FF. Therefore, the polarity of the pre-charging signal $Vsc_{j+1}$ is opposite to the polarity of the pre-charging signals $Vsc_j$ and $Vsc_{j+2}$. In this way, row-inversion driving can be achieved and flicker is thus prevented.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A driving method for rapidly charging pixels of a liquid crystal display, wherein the liquid crystal display comprises a plurality of data lines, a plurality of scan lines, at least one common electrode, and a plurality of pixel units corresponding to sets of the interlacing data lines and scan lines, and each of the pixel units comprises a TFT having a gate coupled to the corresponding scan line, a first electrode coupled to the corresponding data line, and a second electrode, a storage capacitor having a terminal coupled to the second electrode, and a liquid crystal cell coupled between the second electrode and the common electrode, the method comprising the steps of:

providing a plurality of storage electrodes, each corresponding to one of the scan lines and coupled to the other terminal of the storage capacitor;

sequentially generating a plurality of pre-charging signals, respectively output to the storage electrodes, wherein the pre-charging signals vary periodically; and sequentially generating a plurality of scan signals, respectively output to the scan lines;

wherein a variation in a voltage level of each of the pre-charging signals occurs before one of the scan signals is applied to the corresponding scan line.

2. The driving method as claimed in claim 1, wherein the variation in the voltage level of the pre-charging signal applied to the storage electrode corresponding to a row is triggered by the scan signal applied to the scan line corresponding to the previous row.

3. The driving method as claimed in claim 1, wherein polarities of any two adjacent pre-charging units are opposite.

4. A liquid crystal display, comprising:

a plurality of data lines;

a plurality of scan lines;

a plurality of storage electrodes disposed correspondingly on the scan lines;

at least one common electrode;

a plurality of pixel units, each corresponding to one set of interlacing data line and scan line;

each of the pixel units comprising:

a TFT having a gate coupled to the corresponding scan line, a first electrode coupled to the corresponding data line, and a second electrode;

a storage capacitor coupled between the corresponding storage electrode and the second electrode; and a liquid crystal cell coupled between the second electrode and the common electrode;

a scan line driver sequentially generating a plurality of scan signals respectively output to the scan lines; and a pre-charging driver sequentially generating a plurality of pre-charging signals output to the storage electrodes, driving the pre-charging signals to vary periodically, and controlling variations in voltage levels of the pre-charging signals to occur before the scan signals are applied to the scan lines.

5. The liquid crystal display as claimed in claim 4, wherein the pre-charging driver is coupled to the scan lines, and when the scan signals are respectively applied to the scan lines, the scan signals respectively trigger the voltage levels of the pre-charging signals to vary.

6. The liquid crystal display as claimed in claim 5, wherein the pre-charging driver comprises a plurality of pre-charging units, each coupled between a corresponding scan line and storage electrode.

7. The liquid crystal display as claimed in claim 6, wherein one of any two adjacent pre-charging units comprises a D-type flip-flop, and the other of the two adjacent pre-charging units comprises a D-type flip-flop and a inverter.

8. The liquid crystal display as claimed in claim 6, wherein each of the pre-charging units comprises a D-type flip-flop.

9. The liquid crystal display as claimed in claim 4, wherein polarities of any two adjacent pre-charging units are opposite.

* * * * *